US007648060B2

(12) United States Patent
DeBusk

(10) Patent No.: US 7,648,060 B2
(45) Date of Patent: Jan. 19, 2010

(54) CARTON HAVING OPENING FEATURES

(75) Inventor: Patrick J. DeBusk, Larue, TX (US)

(73) Assignee: Graphic Packaging International, Inc., Marietta, GA (US)

( * ) Notice: Subject to any disclaimer, the term of this patent is extended or adjusted under 35 U.S.C. 154(b) by 688 days.

(21) Appl. No.: 11/266,109

(22) Filed: Nov. 3, 2005

(65) Prior Publication Data

US 2006/0091191 A1 May 4, 2006

Related U.S. Application Data

(60) Provisional application No. 60/654,983, filed on Feb. 22, 2005, provisional application No. 60/625,054, filed on Nov. 4, 2004, provisional application No. 60/624,713, filed on Nov. 3, 2004.

(51) Int. Cl.

| | |
|---|---|
| ***B65D 5/00*** | (2006.01) |
| ***B65D 17/00*** | (2006.01) |
| ***B65D 43/00*** | (2006.01) |
| ***B65D 65/00*** | (2006.01) |
| ***B65D 75/00*** | (2006.01) |
| ***A47F 1/04*** | (2006.01) |

(52) U.S. Cl. ..... 229/122; 229/242; 229/240; 229/160.2; 206/427; 221/302; 221/305

(58) Field of Classification Search ..... 229/122, 229/240, 160.2, 242; 206/427; 221/302, 221/303, 305

See application file for complete search history.

(56) References Cited

U.S. PATENT DOCUMENTS

| | | | | |
|---|---|---|---|---|
| 2,115,673 | A | 4/1938 | Stompe | |
| 2,299,027 | A | 10/1942 | Novak | |
| 2,974,846 | A | 3/1961 | Struble | |
| 2,996,344 | A | 8/1961 | Garman | |
| 3,178,242 | A | 4/1965 | Ellis et al. | |
| 3,263,861 | A | 8/1966 | Carr | |
| 3,265,283 | A | 8/1966 | Farquhar | |
| 3,356,279 | A | 12/1967 | Root | |
| 4,396,143 | A | 8/1983 | Killy | |
| 5,344,066 | A | 9/1994 | Fogle | |
| 5,878,947 | A | 3/1999 | Hoy et al. | |
| 6,105,854 | A | 8/2000 | Spivey et al. | |
| 6,484,903 | B2 | 11/2002 | Spivey et al. | |
| 6,715,639 | B2 | 4/2004 | Spivey | |
| 6,866,185 | B2 | 3/2005 | Harrelson | |
| 6,866,188 | B2 | 3/2005 | Harrelson | |
| 6,929,172 | B2 | 8/2005 | Bates et al. | |
| 6,959,857 | B2 * | 11/2005 | Bates | 229/122.1 |
| 6,974,072 | B2 | 12/2005 | Harrelson | |
| 6,991,107 | B2 | 1/2006 | Harrelson | |
| 7,237,674 | B2 * | 7/2007 | Auclair | 206/427 |
| 7,401,711 | B2 * | 7/2008 | Spivey, Sr. | 221/305 |

(Continued)

FOREIGN PATENT DOCUMENTS

| | | | |
|---|---|---|---|
| DE | 85 14 718.4 | | 8/1985 |
| DE | 36 12 594 | A1 | 10/1987 |
| WO | WO 03/008277 | A2 | 1/2003 |
| WO | WO 03/082686 | A1 | 10/2003 |
| WO | WO 2004/043790 | A2 | 5/2004 |

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton includes a V-shaped opening in an exiting end of the carton that allows articles in the carton to be accessed through the exiting end.

37 Claims, 11 Drawing Sheets

U.S. PATENT DOCUMENTS

| | | | |
|---|---|---|---|
| 2003/0141313 | A1 | 7/2003 | Bates |
| 2003/0150759 | A1 | 8/2003 | White, Jr. |
| 2003/0192905 | A1 | 10/2003 | Spivey |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0159671 | A1 | 8/2004 | Spivey |
| 2004/0188277 | A1 | 9/2004 | Auclair |

* cited by examiner

CARTON HAVING OPENING FEATURES

RELATED APPLICATIONS

This application claims the benefit of U.S. Provisional Applications No. 60/624,713, filed on Nov. 3, 2004, Ser. No. 60/625,054, filed on Nov. 4, 2004, and Ser. No. 60/654,983, filed on Feb. 22, 2005, the entire contents of these applications being hereby incorporated by reference as if presented herein.

BACKGROUND

Enclosed cartons with dispensing features have been used in the past. Many of these cartons include article dispensers defined by lines of disruption such as tear lines, cuts, score lines, and fold lines. A dispenser may be removable from, or hingedly attached to, a carton to create an opening from which articles can be removed from the carton. In many instances, after the user opens the dispenser, some of the cans or articles, especially those disposed in a lower row or rows, are positioned substantially or entirely below the opening created by the dispenser, rendering removal of cans from the carton difficult.

SUMMARY

According to a first embodiment of the invention, a carton comprises a dispenser that when opened, forms a dispenser opening having a V-shaped portion in an exiting end panel of the carton. Once the dispenser is opened or placed in a dispensing configuration, portions of the carton's exiting end remain intact and are capable of retaining articles within the carton.

According to one aspect of the present invention, the V-shaped opening provides access to selected articles through the exiting end panel. The V-shaped opening can be formed in the exiting end panel such that the strength and rigidity of the exiting end panel and the carton itself are not unnecessarily compromised.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

The present invention generally relates to dispensers for cartons. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical beverage containers as disposed within the carton embodiments. In this specification, the relative terms "lower," "bottom," "upper" and "top" may indicate orientations determined in relation to fully erected cartons.

Figure 1:
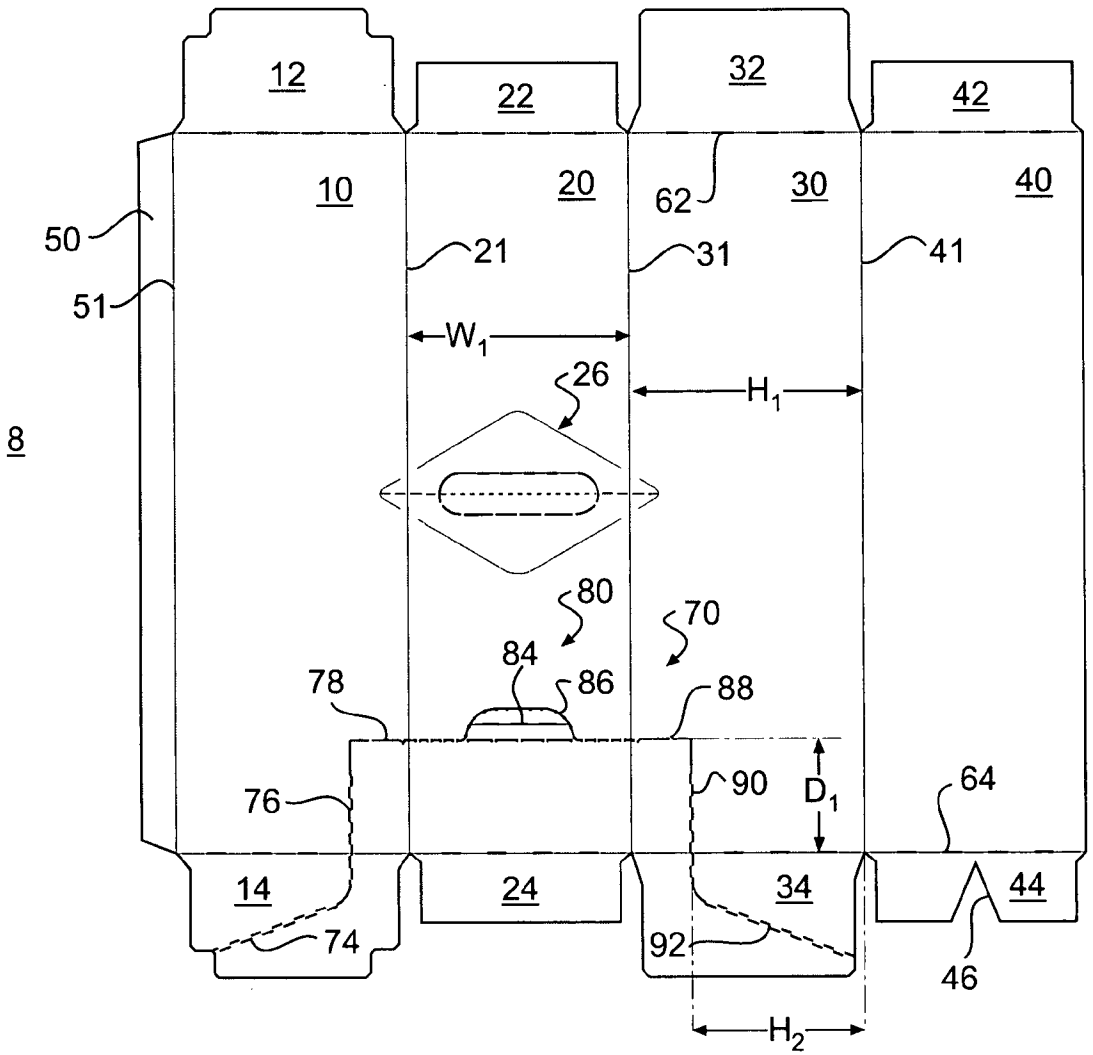
FIG. 1 is a plan view of a blank from which a carton according to a first embodiment of the invention is formed.

FIG. 1 is a plan view of a blank 8 used to form a carton 150 (illustrated in FIGS. 4 and 5) according to a first embodiment of the invention. The blank 8 comprises a first side panel 10 foldably connected to a top panel 20 at a first transverse fold line 21, a second side panel 30 foldably connected to the top panel 20 at a second transverse fold line 31, and a bottom panel 40 foldably connected to the second side panel 30 at a third transverse fold line 41. An adhesive flap 50 may be foldably connected to the first side panel 10 at a fourth transverse fold line 51. The blank 8 may include a handle 26 in the top panel 20. The handle 26 can generally be any type of conventional handle.

The first side panel 10 is foldably connected to a first side end flap 12 and a first side exiting end flap 14. The top panel 20 is foldably connected to a top end flap 22 and a top exiting end flap 24. The second side panel 30 is foldably connected to a second side end flap 32 and a second side exiting end flap 34. The bottom panel 40 is foldably connected to a bottom end flap 42 and a bottom exiting end flap 44. The end flaps 12, 22, 32, 42 may extend along a first marginal area of the blank 8, and may be foldably connected along a first longitudinally extending fold line 62. The exiting end flaps 14, 24, 34, 44, 54 may extend along a second or bottom marginal area of the blank 8, and may be foldably connected along a second longitudinally extending fold line 64. The longitudinal fold lines 62, 64 may be straight or substantially straight fold lines, or may be offset at one or more locations to account for, for example, blank thickness. When the carton 150 is erected, the end flaps 12, 22, 32, 42 close a back end of the carton 150, and the exiting end flaps 14, 24, 34, 44 close a front or exiting end of the carton 150.

Figure 4:
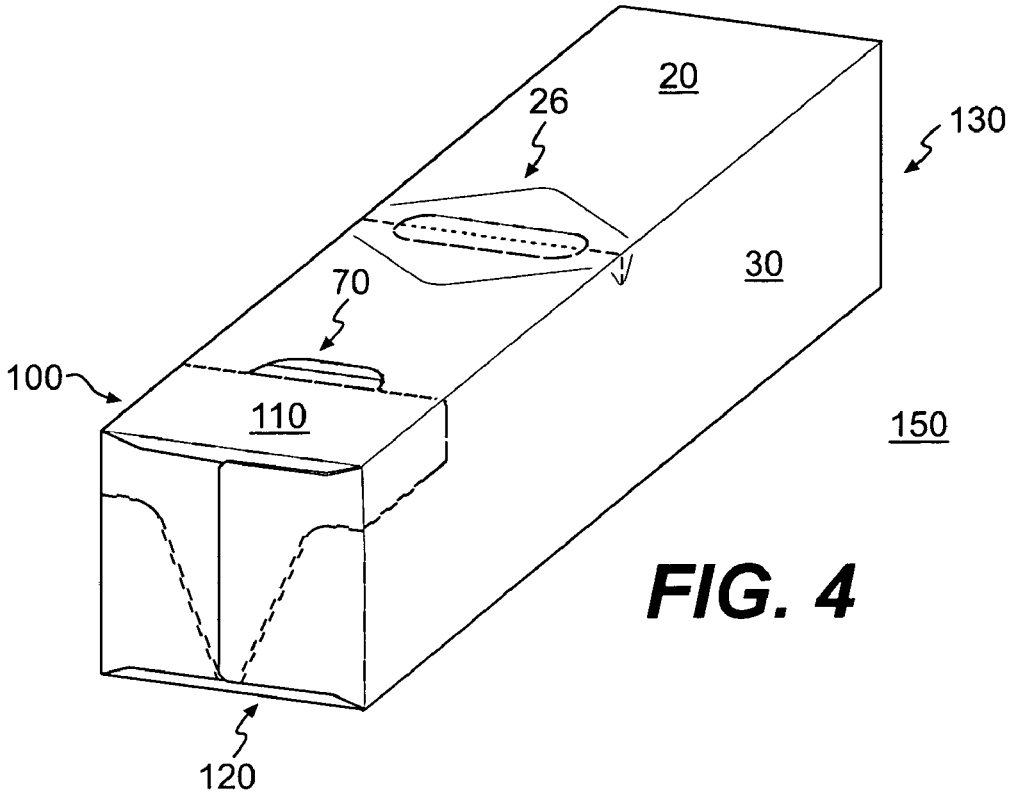
FIG. 4 is a perspective view of the first carton embodiment.
Figure 5:
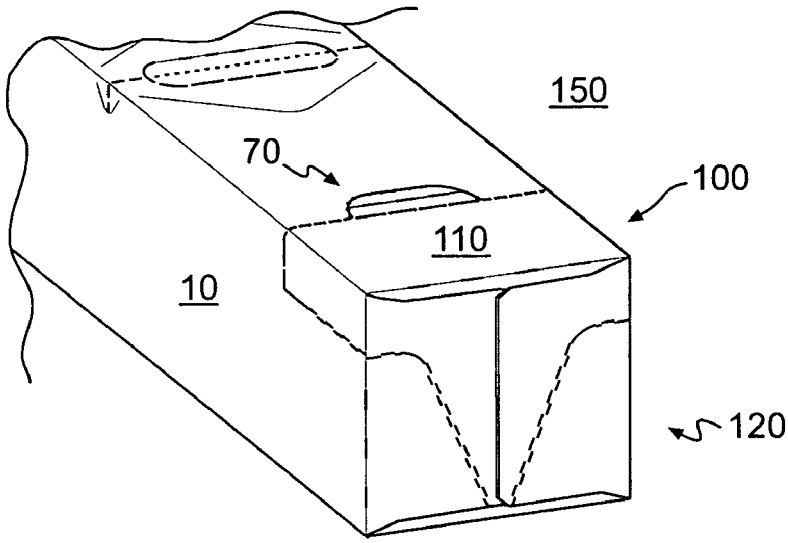
FIG. 5 is a partial, perspective view of the first carton embodiment.

The carton blank 8 includes a dispenser pattern 70 that defines a dispenser 100 in the erected carton 150 (illustrated in FIGS. 4 and 5). The dispenser pattern 70 comprises a first end tear line 74 that extends obliquely through the first side exiting end flap 14, and a second end tear line 92 that extends obliquely through the second side exiting end flap 34. The first end tear line 74 extends to a point at or adjacent to a first side tear line 76 extending generally transversely through the first side panel 10. The second end tear line 92 extends to a point at or adjacent to a second side tear line 90 extending generally transversely through the second side panel 30. A first longitudinally extending tear line 78 extends between a point at or adjacent to the first side tear line 76 and an opening feature 80. A second side longitudinally extending tear line 88 extends between a point at or adjacent to the second side tear line 90 and the opening feature 80. The opening feature 80 can be defined by, for example, an exterior tear line 86 and an intermediate fold line 84, and can be generally conventional in construction. The bottom exiting end flap 44 can have a V-shaped notch or cutout 46 cut into the flap. The slope of the interior edges of the notch 46 may be selected to be complementary to the slope of the obliquely extending first and second end tear lines 74, 92 in the erected carton 150, as will be discussed further below.

The tear lines 74, 76, 78, 86, 88, 90, 92 of the dispenser pattern 70 can be formed from continuous or substantially continuous tear lines formed by, for example, scores, creases, cuts, gaps, cut/creases, perforations, offset cuts, and combinations thereof. If cuts are used to form the tear lines 74, 76, 78, 86, 88, 90, 92, the cuts may be, for example, interrupted by breachable nicks.

The dimensions of the blank 8 may be selected to accommodate defining or characteristic dimensions of articles to be accommodated within the carton 150. For example, the top panel 20 can have a width $W_1$ that generally corresponds to or slightly exceeds a height of containers C (illustrated in FIGS. 9 and 11) or other articles to be accommodated within the carton 150. When cylindrical or substantially cylindrical containers C are used, the first and second side panels 10, 30 can have, for example, a height $H_1$ that generally correspond to or slightly exceed an integral multiple of a largest or characteristic diameter Dc of the containers C. For example, if the containers C are to be stacked in two rows in the carton 150 (FIGS. 9 and 11), the height $H_1$ of the carton 150 can be about equal to or slightly greater than twice the containers' C largest or characteristic diameter $D_C$. If multiple generally cylindrical containers C, such as beverage containers, are to be accommodated, it may be expected that the containers will share at least one substantially equal common largest diameter $D_C$. Erection of the carton is discussed below with reference to FIGS. 2 and 3.

Figure 2:
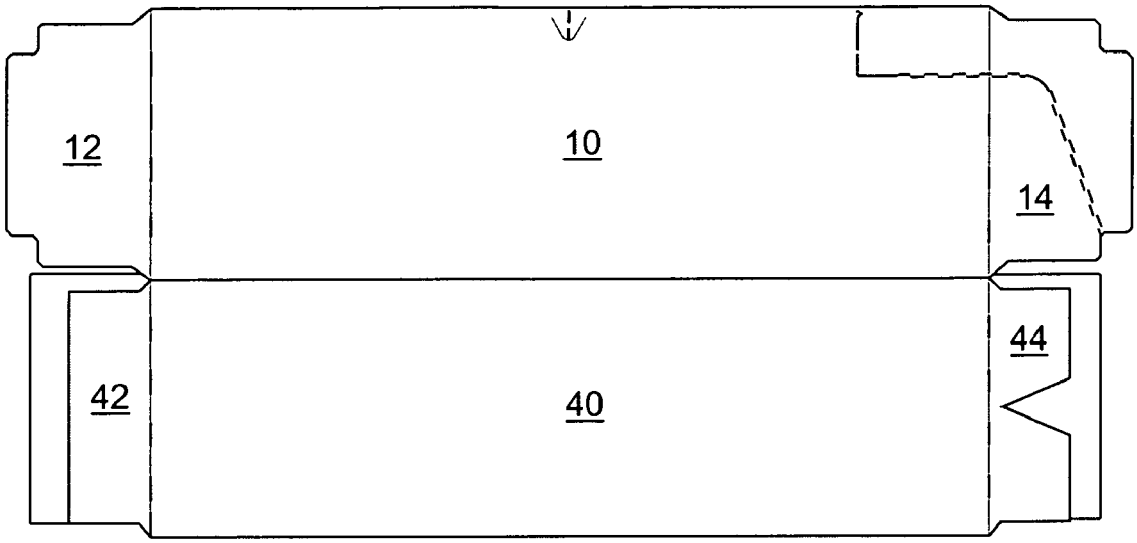
FIG. 2 illustrates the carton according to the first embodiment in a partially erected state.
Figure 3:
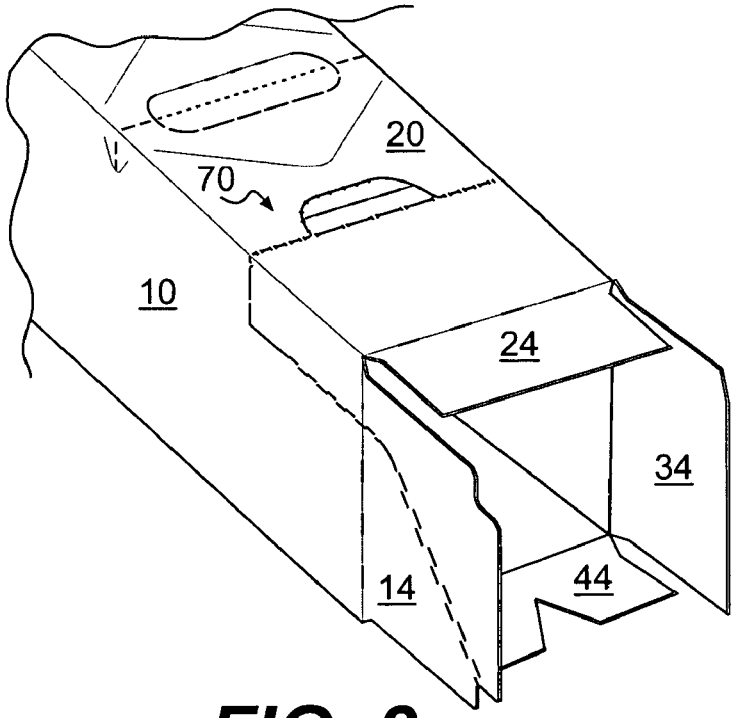
FIG. 3 illustrates the carton according to the first embodiment in another partially erected state.

Referring to FIG. 2, the carton 150 may be erected from the blank 8 by gluing or otherwise adhering the adhesive flap 50 (shown in FIG. 1) to the inner side of the bottom panel 40 so that the bottom panel 40, the first side panel 10, the top panel 20, and the second side panel 30 may be opened or set up to form a generally tubular sleeve, as shown in FIG. 3.

Referring to FIG. 3, the ends of the generally tubular sleeve may be closed, for example, by folding and adhering the end flaps 12, 22, 32, 42 and the exiting end flaps 14, 24, 34, 44. The exterior surface of the bottom exiting end flap 44 can be, for example, glued to interior surfaces of the first and second side exiting end flaps 14, 34 on either side of the V-shaped notch 46. Substantially cylindrical containers C or other articles, for example, may be loaded into the sleeve in a conventional manner at any time before one or both ends of the carton are closed by the end flaps 12, 22, 32, 42, 14, 24, 34, 44.

FIGS. 4 and 5 are perspective views of the carton 150 erected from the blank 8 illustrated in FIG. 1. In the erected carton 150, the end flaps 12, 22, 32, 42 form an end panel 130 and the exiting end flaps 14, 24, 34, 44 form an exiting end panel 120. The dispenser pattern 70 defines a dispenser 100 having a dispenser flap 110 that may be removed in order to place the carton 150 in an open or dispensing configuration.

Figure 6:
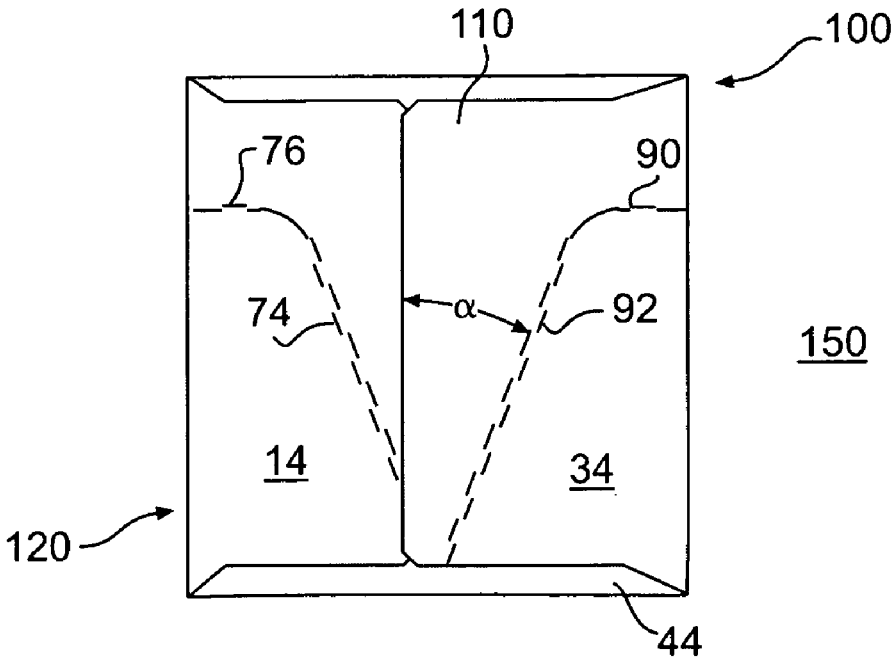
FIG. 6 is an end view of the first carton embodiment.
Figure 7:
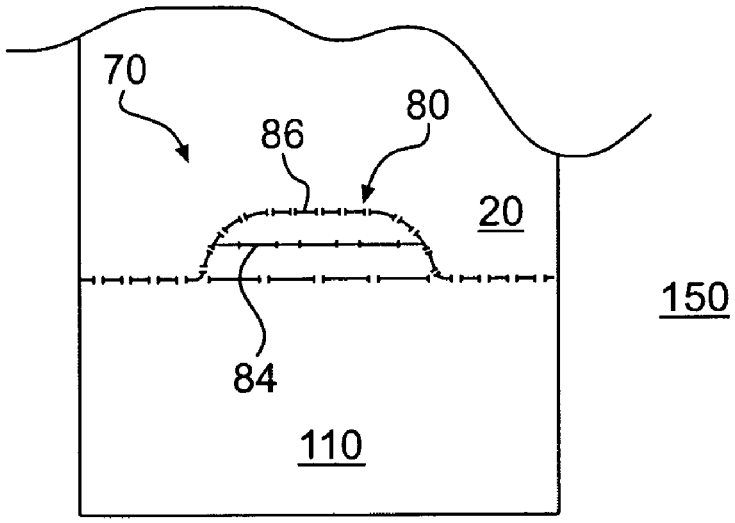
FIG. 7 is a partial, top plan view of the first carton embodiment.

FIG. 6 is an end view of the carton 150 and FIG. 7 is a partial top plan view of the carton 150. Referring to FIG. 6, the first and second end tear lines 74, 92 and the V-shaped notch 46 (illustrated in FIG. 1) in the bottom exiting end flap 44 define a generally V-shaped portion of the dispenser flap 110 in the exiting end panel 120. The second end tear line 92 may be disposed at an angle $\alpha$ measured with respect to vertical, or alternatively, measured with respect to the upright first side panel 10 (FIG. 5). The first end tear line 74 may likewise be disposed at the angle $\alpha$ with respect to vertical, or with respect to the upright second side panel 30 (FIG. 4), so that an angle $2\alpha$ is subtended by the first and second end tear lines 74, 92. Upper edges of the first and second end tear lines 74, 92 may turn at arcuate portions and extend substantially horizontally across the upper portion of the exiting end panel 120.

Figure 8:
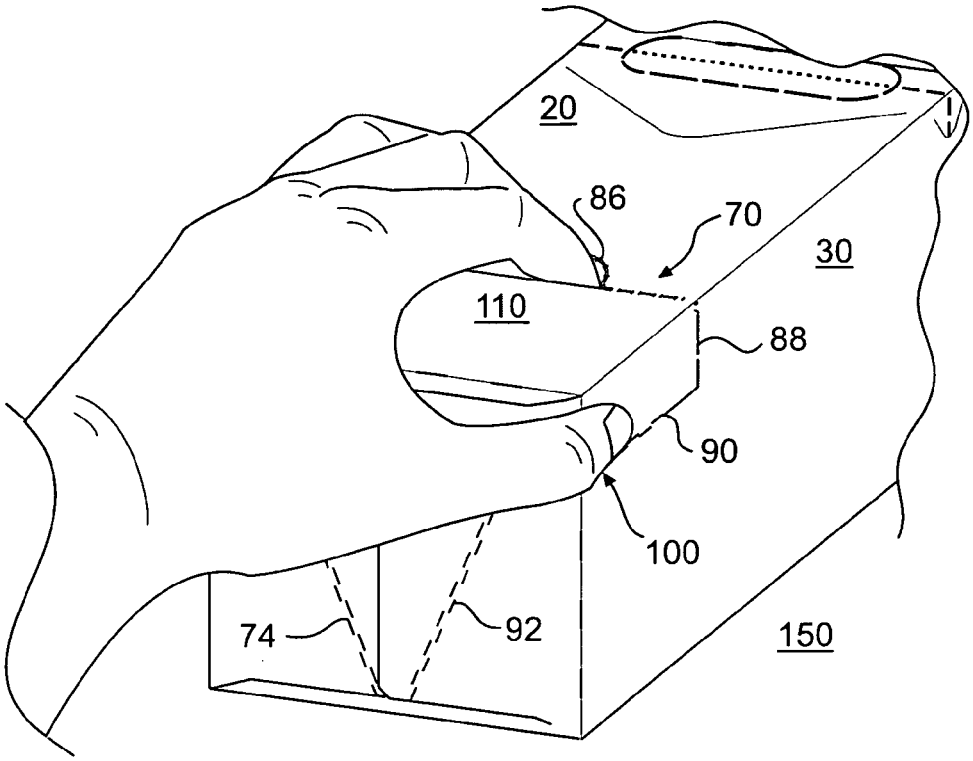
FIG. 8 illustrates opening of the dispenser of the first carton embodiment.
Figure 9:
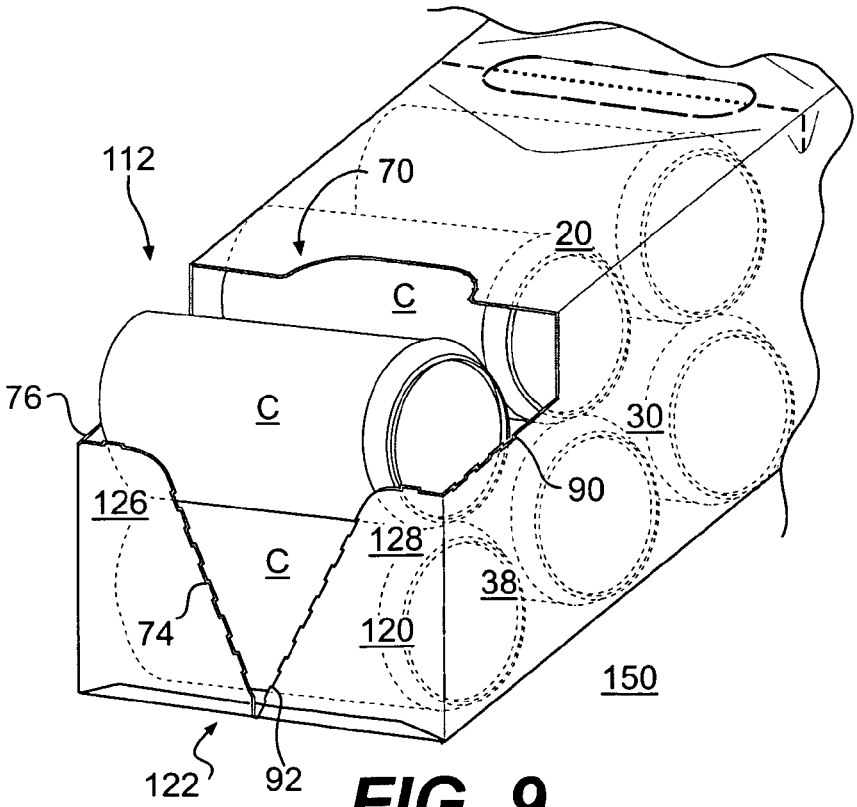
FIG. 9 is a partial, perspective view of the dispenser of the first embodiment in an opened or dispensing configuration.

Opening of the carton dispenser 100 is discussed below with reference to FIGS. 8-9. Referring to FIG. 8, opening of the dispenser 100 may be initiated by inserting a finger, fingers, a tool, or other object into the carton 150 at the opening feature 80 and tearing along the tear line 86. Referring also to FIG. 9, the dispenser 100 is fully opened by pulling the dispenser flap 110 outwardly and downwardly and tearing the carton 150 along the first and second end tear lines 74, 92 and the first and second side tear lines 76, 90.

As shown in FIG. 9, removal of the dispenser flap 110 creates a dispenser opening 112 in the carton 150. The dispenser opening 112 is defined by the laterally extending tear side lines 76, 90 in the first and second side panels 10, 30, and the obliquely extending end tear lines 74, 92 in the exiting end panel 120. After removing the dispenser flap 110, the exiting end panel 120 is left with a first end retainer section 126 and a second end retainer section 128. The first side panel 10 is left with a first side retainer section 18 (FIG. 11), and the second side panel 30 is left with a second side retainer section 38.

In accordance with the first embodiment of the present invention, the first and second end retainer sections 126, 128 define a V-shaped portion 122 of the dispenser opening 112 in the exiting end panel 120. The V-shaped notch 46 in the bottom exiting end panel 44 (FIG. 1) can be substantially complementary in shape to the V-shaped portion 122.

Figure 10:
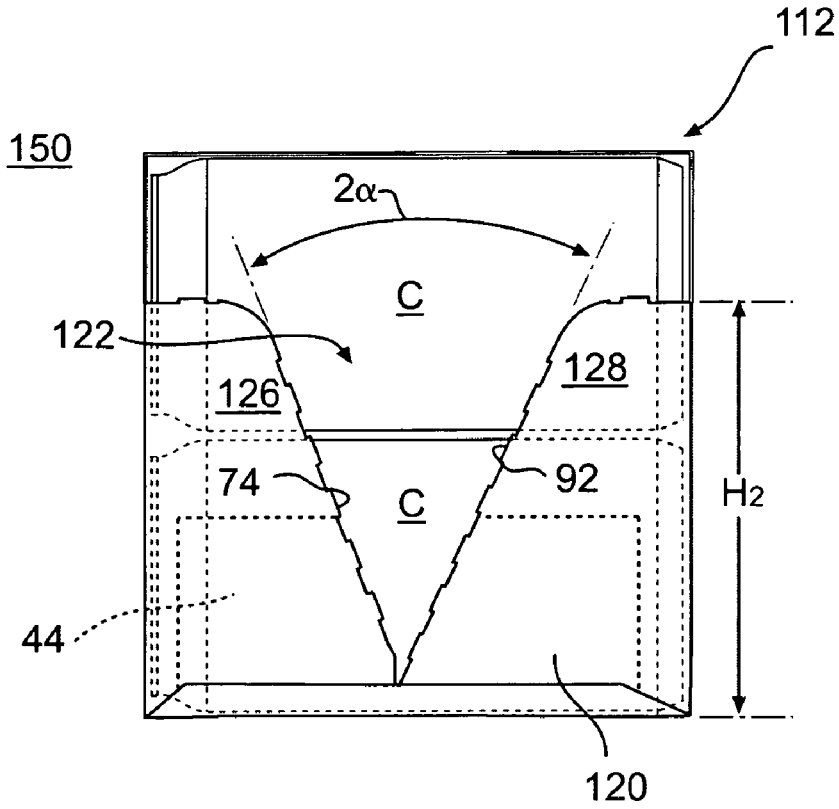
FIG. 10 is an end view of the dispenser of the first embodiment in the opened or dispensing configuration.
Figure 11:
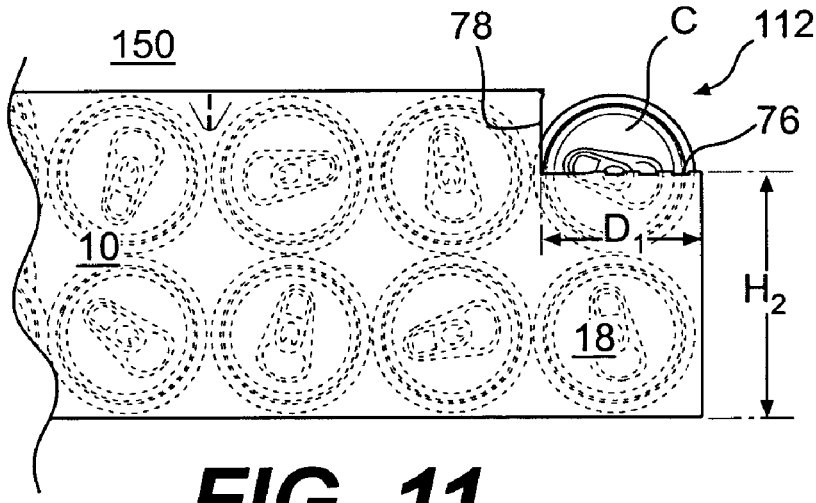
FIG. 11 is a partial, side elevational view of the dispenser of the first embodiment in the opened or dispensing configuration.

Referring to FIGS. 10 and 11, the V-shaped portion 122 of the dispenser opening 112 subtends an angle of approximately $2\alpha$. The first and second end retainer sections 126, 128 can have, for example, a height $H_2$ in the range of about 105-200% of the characteristic dimension or diameter $D_C$ of the containers C. The subtended angle $2\alpha$ can be in the range of, for example, about 35-70 degrees. In the embodiment shown in FIG. 10, the angle $2\alpha$is about 45 degrees. The first and second side tear lines 76, 90 can extend into the panels 20, 30 a depth of $D_1$ in the range of, for example, about 90-300% of the characteristic dimension or diameter $D_C$. The bottom exiting end flap 44 (indicated by hidden lines in FIG. 10) is covered by the end retainer sections 126, 128, and can be glued or otherwise adhered to the interior surfaces of the first and second end retainer sections 126, 128.

Figure 12:
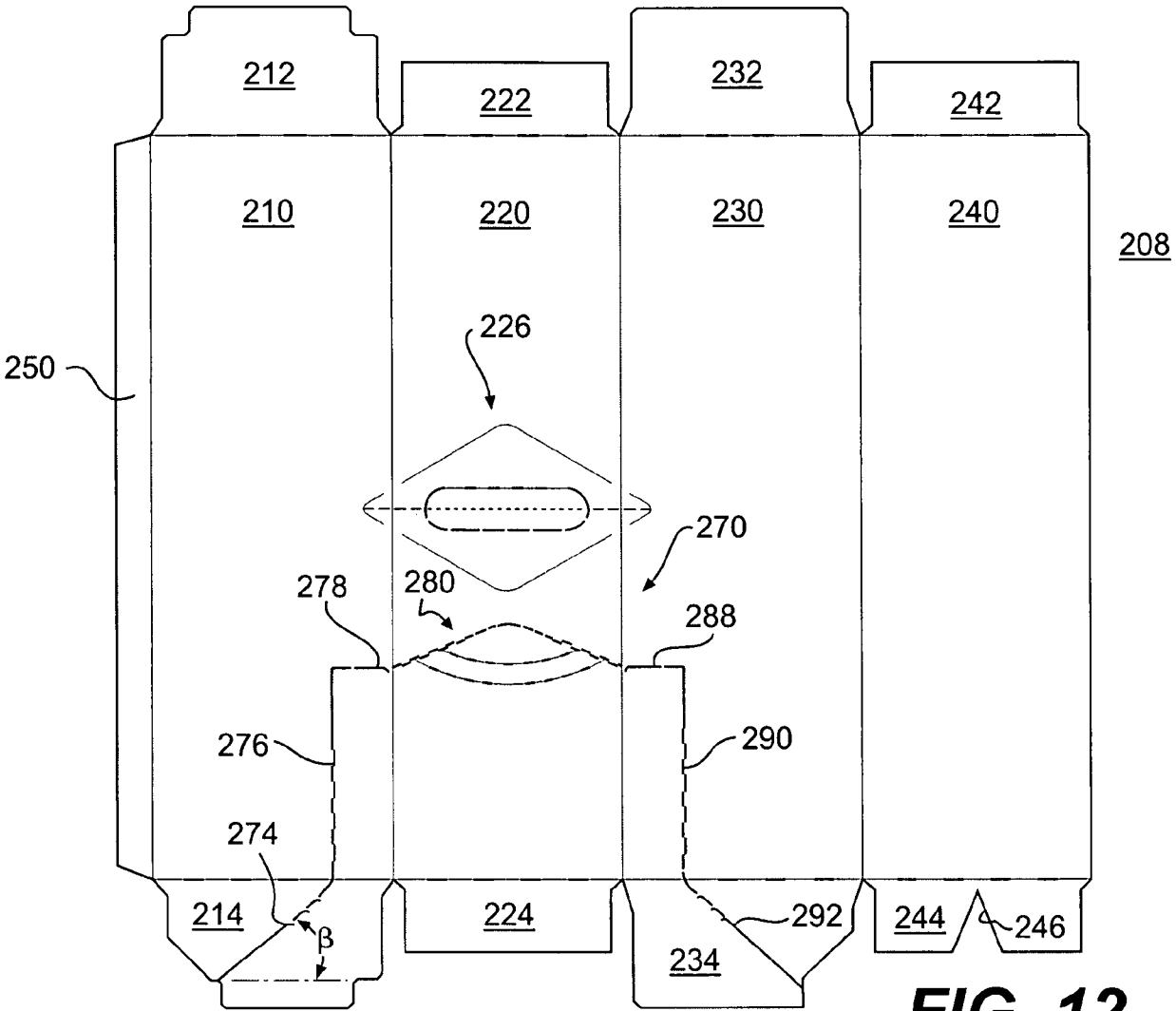
FIG. 12 is a plan view of a blank from which a carton according to a second embodiment of the invention is formed.

FIG. 12 is a plan view of a blank 208 used to form a carton 350 (illustrated in FIG. 13) according to a second embodiment of the invention. The blank 208 comprises a first side panel 210, a top panel 220, a second side panel 230, a bottom panel 240, an adhesive flap 250 and a handle 226 in the top panel 220. The blank 208 and the corresponding carton 350 constructed therefrom can be generally similar to the blank 8 and carton 150 discussed above, and like or similar reference numbers in the figures indicate like or similar elements.

Figure 13:
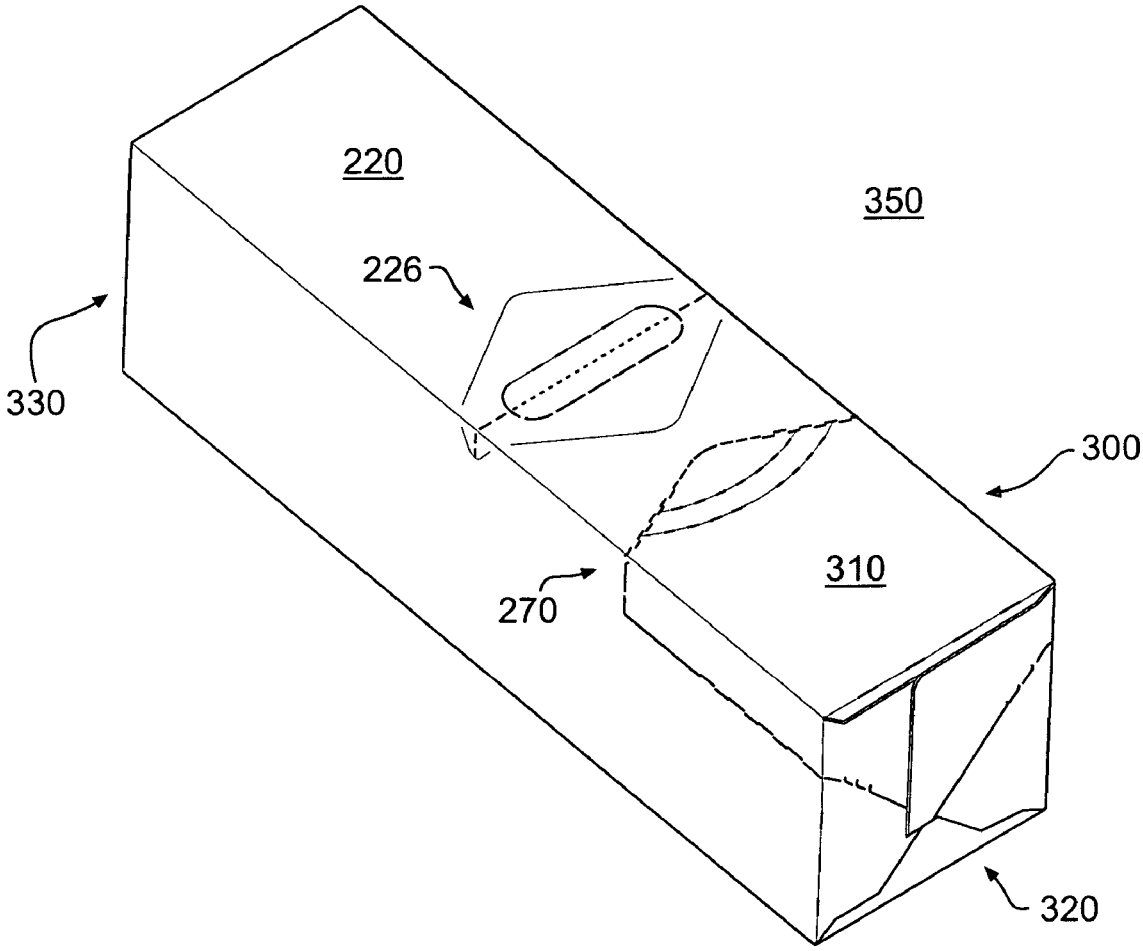
FIG. 13 is a perspective view of the second carton embodiment.

The carton blank 208 includes a dispenser pattern 270 that defines a dispenser 300 in the erected carton 350 (illustrated in FIG. 13). The dispenser pattern 270 comprises a first end tear line 274 that extends obliquely through the first side exiting end flap 214, and a second end tear line 292 that extends obliquely through the second side exiting end flap 234. The first end tear line 274 extends to a point at or adjacent to a first side tear line 276 that extends generally transversely through the first side panel 210. The second end tear line 292 extends to a point at or adjacent to a second side tear line 290 that extends generally transversely through the second side panel 230. A first longitudinally extending tear line 278 extends between a point at or adjacent to the first side tear line 276 and an opening feature 280. A second side longitudinally extending tear line 288 extends between a point at or adjacent to the second side tear line 290 and the opening feature 280. The bottom exiting end flap 244 can have a V-shaped notch or cutout 246 cut into the flap. The tear lines 274, 276, 278, 286, 288, 290, 292 can be continuous or substantially continuous tear lines formed by, for example, scores, creases, cuts, gaps, cut/creases, perforations, offset cuts, and combinations thereof.

FIG. 13 is a perspective view of the carton 350 erected from the blank 208 illustrated in FIG. 12. The carton 350 includes an end panel 330 and an exiting end panel 320. The dispenser pattern 270 defines the dispenser 300 having a dispenser flap 310 that may be removed in order to open the carton 350.

Figure 14:
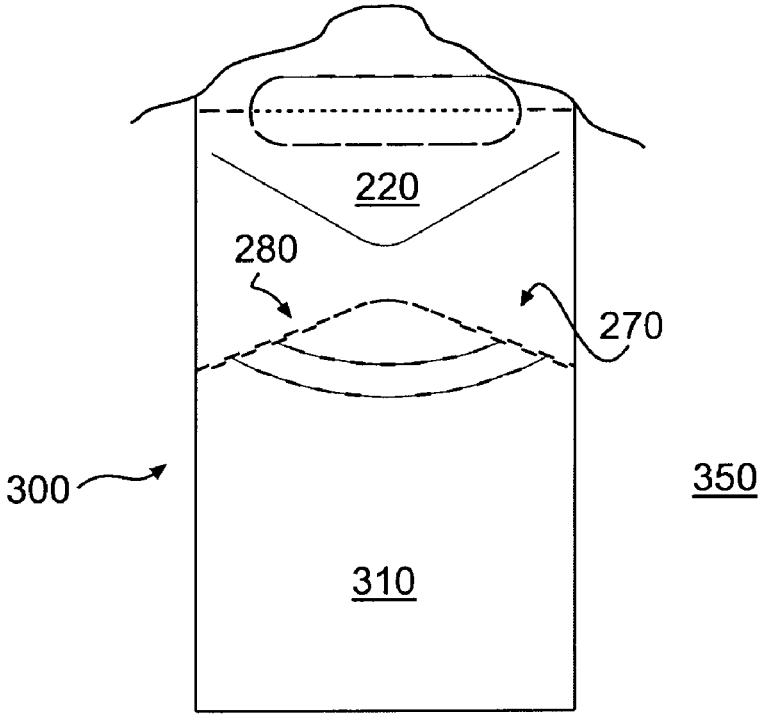
FIG. 14 is a partial, top plan view of the second carton embodiment.
Figure 15:
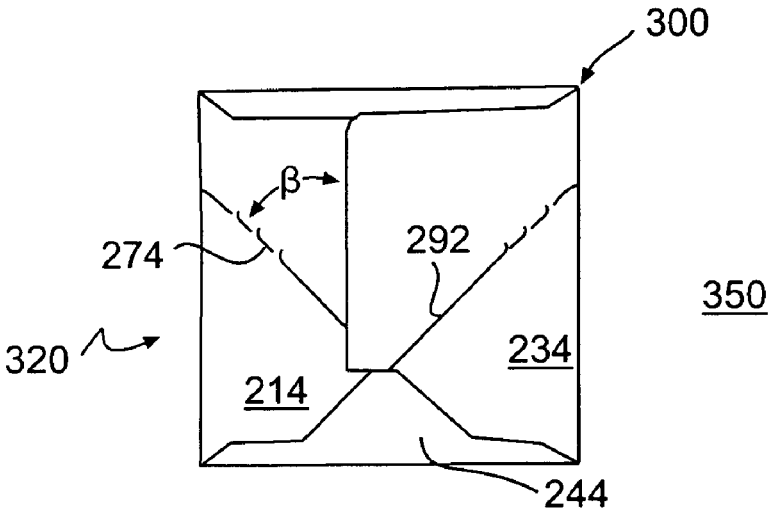
FIG. 15 is an end view of the second carton embodiment.

FIG. 14 is a partial top view of the carton 350 and FIG. 15 is an end view of the carton 350. Referring to FIG. 15, in the second embodiment, the first and second end tear lines 274, 292 and the V-shaped notch in the bottom exiting end flap 244 (shown in FIG. 1) define a generally V-shaped portion of the dispenser flap 310 in the exiting end panel 320. The second end tear line 292 may be disposed at an angle β measured with respect to vertical, or alternatively, measured with respect to the first side panel 210. The first end tear line 274 may likewise be disposed at the angle β with respect to vertical, or with respect to the second side panel 230, so that an angle 2β is subtended between the first and second end tear lines 274, 292.

Figure 16:
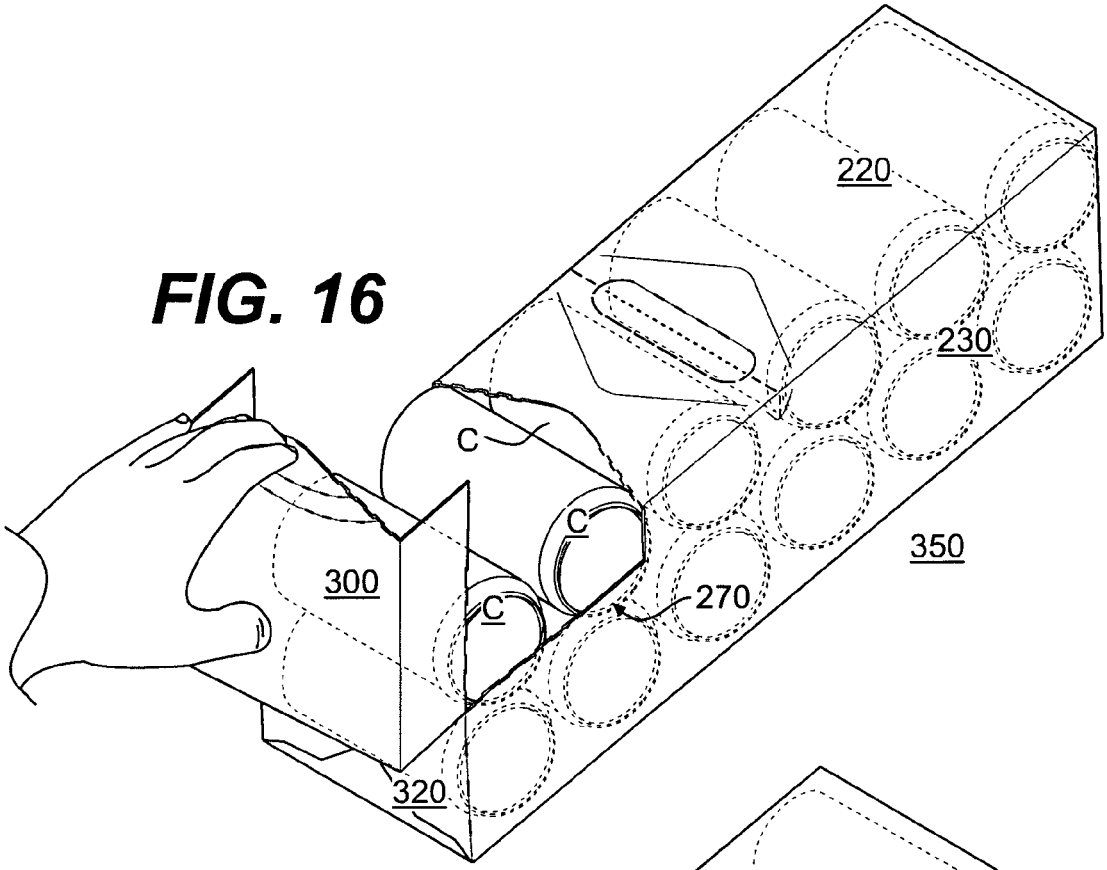
FIG. 16 illustrates opening of the dispenser of the second carton embodiment.
Figure 17:
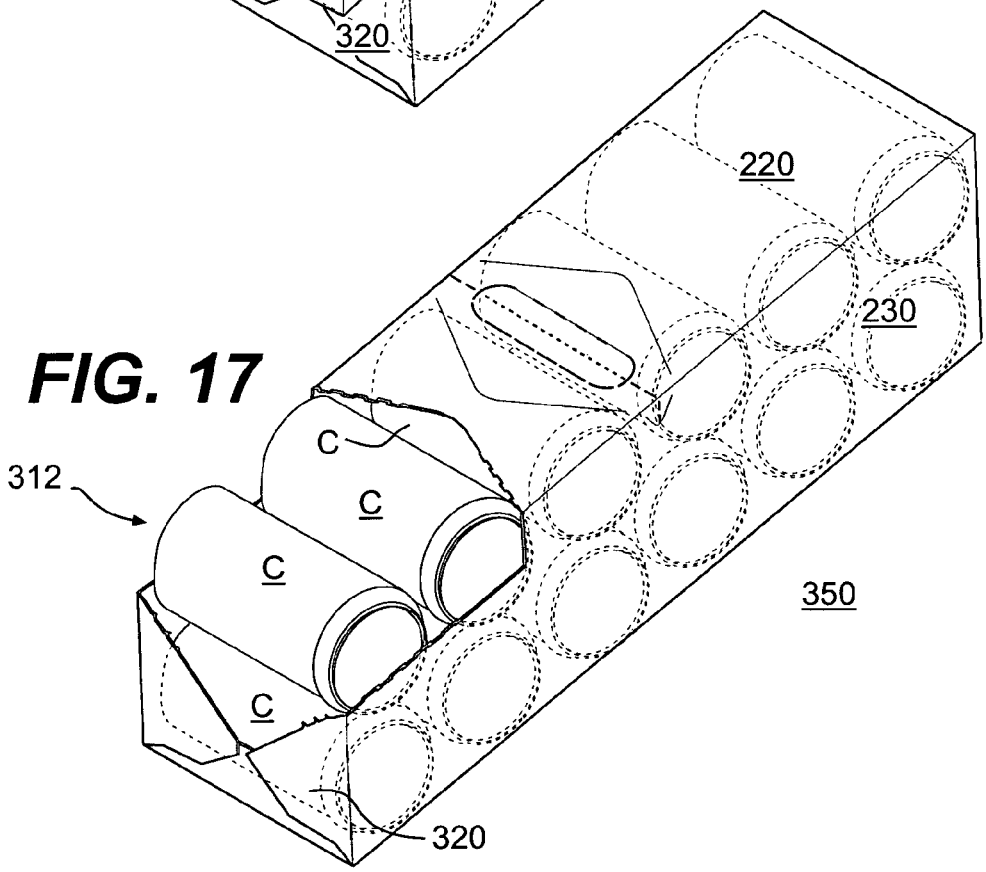
FIG. 17 is a partial, perspective view of the dispenser of the second embodiment in an opened or dispensing configuration.
Figure 18:
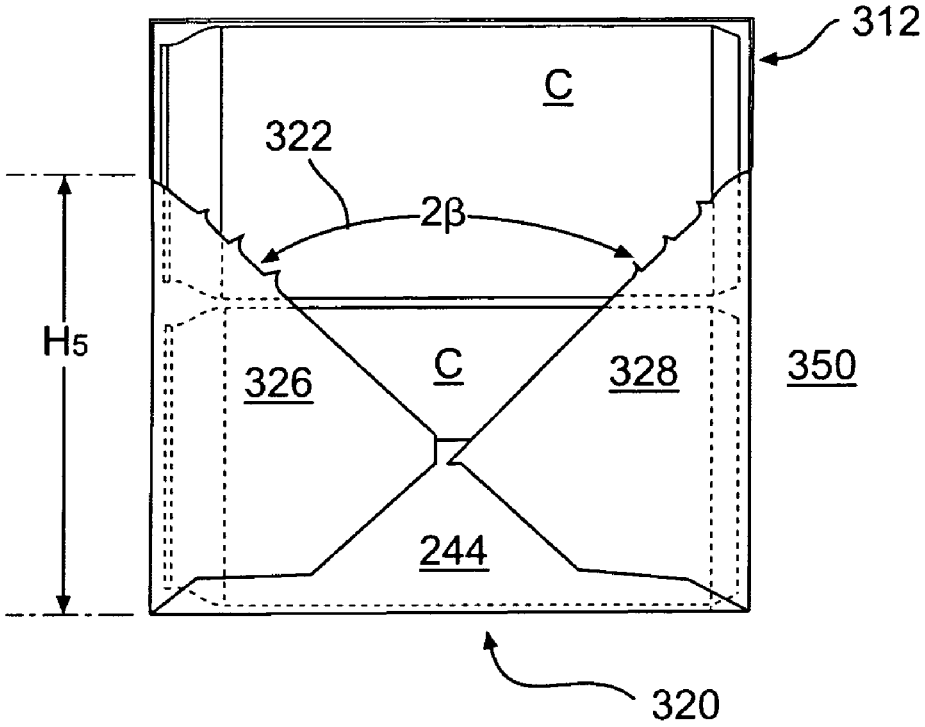
FIG. 18 is an end view of the dispenser of the second embodiment in the opened or dispensing configuration.
Figure 19:
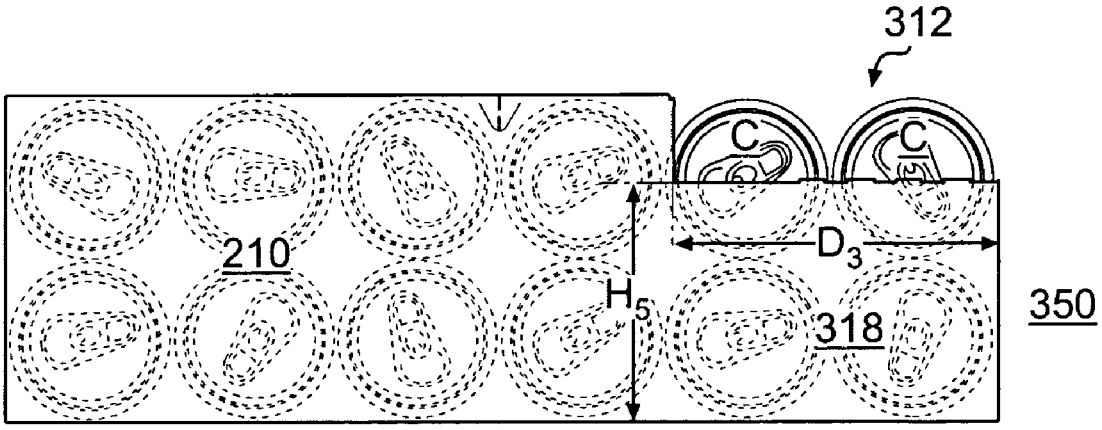
FIG. 19 is a side elevational view of the dispenser of the second embodiment in the opened or dispensing configuration.

FIGS. 16-17 illustrate opening of the carton dispenser 300. Removal of the dispenser flap 310 creates a dispenser opening 312 in the carton 350. Referring to FIGS. 18 and 19, after removing the dispenser flap 310, the exiting end panel 320 is left with a first end retainer section 326 and a second end retainer section 328. The first side panel 210 is left with a first side retainer section 318 (FIG. 19), and the second side panel 230 is left with a second side retainer section (not shown).

In accordance with the second embodiment of the invention, the first and second end retainer sections 326, 328 define a V-shaped portion 322 of the dispenser opening 312 in the exiting end panel 320. The V-shaped notch 346 (FIG. 12) in the bottom exiting end panel 344 can be substantially complementary in shape to the V-shaped portion 322.

Referring to FIG. 18, the V-shaped portion 322 of the dispenser opening 112 subtends an angle of approximately 2β. The first and second end retainer sections 326, 328 can have a height $H_5$ in the range of, for example, about 105-200% of the characteristic dimension or diameter $D_C$ of the containers C. The angle 2β can be in the range of, for example, about 70-120 degrees. In the embodiment illustrated in FIG. 18, the angle 2β is about 90 degrees. The second and third tear lines 276, 290 can extend into the first and second side panels 210, 230 a depth of $D_3$ in the range of, for example, about 90-300% of the characteristic dimension or diameter $D_C$. The bottom exiting end flap 244 is partially covered by the end retainer sections 326, 328 and can be glued or otherwise adhered to the interior surfaces of the sections 326, 328.

In this specification the term "V-shaped" indicates a profile defined by two lines that need not be perfectly straight. Further, the lines forming the V shape need not actually meet at the vertex of the "V." As illustrated in FIG. 18, the sides of the retainer sections in the exiting end panel may be spaced a small distance at the bottom of the V.

According to the above embodiments, articles may be easily removed from the dispenser opening of a carton when the carton dispenser is opened. The V-shaped opening in the exiting end panel provides additional visibility of the articles inside the carton without entirely exposing all of the articles. The dispenser generally may be formed by perforations or cut lines, which are of such dimensions to provide access to cans or other articles in the carton, without unnecessarily weakening the panel or panels in which the dispenser is formed. The bottom exiting end flap may remain intact at its lower end in order to ensure the integrity of the lower edge of the exiting end of the carton. After the removal of the dispenser flap, the remaining portions of the carton at the exiting end and in the side panels prevent articles, and specifically the next article in the columns or rows of articles adjacent to the exiting end, from inadvertently falling or rolling out of the carton. Thus, the articles are securely retained inside the carton until selectively removed.

For purposes of illustration, the present invention is generally disclosed in the context of paperboard cartons or packages sized and dimensioned to contain cylindrical beverage containers. The cartons illustrated in the drawing figures are sized to accommodate containers in a two row configuration with multiple columns of containers included in each row, although the present invention is not limited to any specific size or dimension. For example, the present invention would work satisfactorily if sized and shaped to hold containers in alternative arrangements, such as 3×4, 4×3, 2×4, 2×5, 4×6, 4×5, 3×6, 5×6, etc.

The present invention can be used in cartons that include various features, including additional opening features that provide easy access to the articles, and tilt features that position the articles at the front end of the carton.

One of ordinary skill will recognize that the dispenser according to the present invention can be disposed in either or both ends of a carton.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier row, on either or both sides of the blanks. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the dispensers to function at least generally as described above. The blanks can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton, comprising:

a first side panel;

a top panel;

a second side panel;

a bottom panel;

a first side exiting end flap extending from the first side panel and along a first marginal area of the blank;

a top exiting end flap extending from the top panel and along the first marginal area of the blank;

a second side exiting end flap extending from the second side panel and along the first marginal area of the blank;

a bottom exiting end flap foldably connected to the bottom panel at a fold line, the bottom exiting end flap having a V-shaped notch having a vertex in the bottom exiting end flap that is proximate to, but spaced apart from, the fold line;

at least one second end flap extending along a second marginal area of the blank; and a dispenser pattern extending through the top panel, the first side panel, the second side panel, the first side exiting end flap, and the second side exiting end flap, wherein the dispenser pattern comprises:

a first oblique tear line extending through the first side exiting end flap; and a second oblique tear line extending through the second side exiting end flap, wherein when the carton is formed, the first and second oblique tear lines terminate adjacent to one another at respective end points that form the vertex of a V-shaped section, the end points being proximate to and spaced from the bottom panel.

2. The blank of claim 1, wherein the dispenser pattern further comprises:

a first side tear line extending across the first side panel, at least a portion of the first side tear line being substantially parallel to the bottom panel and spaced apart from the bottom panel a distance that is greater than a characteristic dimension of a container to be contained within a carton formed by the blank; and a second side tear line extending across the second side panel.

3. The blank of claim 1, wherein the dispenser pattern further comprises an opening feature in the top panel.

4. The blank of claim 1, wherein the blank is constructed from paperboard.

5. A carton and a plurality of containers therein, the containers having at least one common diameter, the carton comprising:

a first side panel;

a top panel;

a second side panel;

an end panel;

an exiting end panel at an end of the carton opposite to the end panel;

a bottom panel; and a dispenser defined by a dispenser pattern extending at least through the top panel, the first side panel, the second side panel, and the exiting end panel, wherein the dispenser pattern defines a dispenser flap that is separatable along the dispenser pattern to form a dispenser opening, the dispenser flap having a substantially V-shaped section in the exiting end panel that terminates at a vertex in a lower portion of the exiting end panel, wherein the dispenser pattern comprises:

an opening feature in the top panel;

a first oblique end line extending across the exiting end panel; and a second oblique end line extending across the exiting end panel, wherein the first and second oblique end lines subtend an angle of between thirty-five and one hundred and twenty degrees, wherein the first and second oblique end lines terminate adjacent to one another at respective end points that form the vertex of the V-shaped section, the end points being proximate to and spaced from the bottom panel, and the first and second oblique end lines define first and second end retainer sections in the exiting end panel.

6. The carton and plurality of containers of claim 5, wherein the exiting end panel comprises a bottom exiting end flap foldably connected to the bottom panel, the bottom exiting end flap having a V-shaped notch.

7. The carton and plurality of containers of claim 5, wherein the exiting end panel comprises:

a bottom exiting end flap foldably connected to the bottom panel, the bottom exiting end flap having a notch formed at a distal edge of the bottom exiting end flap;

a first side exiting end flap foldably connected to the first side panel;

a second side exiting end flap foldably connected to the second side panel; and a top exiting end flap foldably connected to the top panel.

8. The carton and plurality of containers of claim 5, wherein the carton is constructed from paperboard.

9. A carton and a plurality of containers therein, the containers having at least one common diameter and being arranged in at least two rows and three columns, the carton comprising:

a first side panel;

a top panel;

a second side panel;

an exiting end panel at an exiting end of the carton;

a bottom panel; and a dispenser section having a substantially V-shaped section in the exiting end panel that terminates at a vertex in a lower portion of the exiting end panel at a point spaced above the bottom panel, the dispenser section being defined by a dispenser pattern extending at least through the top panel, the side panels, and the exiting end panel, the dispenser pattern comprising:

a first oblique end line extending across the exiting end panel; and a second oblique end line extending across the exiting end panel, the first and second oblique end lines defining an angle in the exiting end panel and at least partially forming the vertex of the V-shaped section, wherein the dispenser section is at least partially separable along the dispenser pattern to form a dispenser opening in the carton, and wherein after separating the dispenser section, the exiting end panel is left with a first end retainer section and a second end retainer section, at least one of the end retainer sections retaining at least one of the containers in a topmost row of the containers.

10. The carton and plurality of containers of claim 9, wherein after separating the dispenser section, at least one container in the topmost row of containers can be grasped from the exiting end of the carton and from either side of the carton.

11. The carton and plurality of containers of claim 10, wherein the dispenser pattern further comprises:

a first side tear line extending across the first side panel, at least a portion of the first side tear line being substantially parallel to and spaced from the top panel; and a second side tear line extending across the second side panel, at least a portion of the second side tear line being substantially parallel to and spaced from the top panel.

12. The carton and plurality of containers of claim 9, wherein the angle is in the range of about thirty-five to seventy degrees.

13. The carton and plurality of containers of claim 9, wherein the angle is in the range of about seventy to one hundred and twenty degrees.

14. The carton and plurality of containers of claim 9, wherein the first and second oblique end lines terminate adjacent to one another proximate to and spaced from the bottom panel.

15. The carton and plurality of containers of claim 9, wherein the exiting end panel comprises a bottom exiting end flap foldably connected to the bottom panel at a fold line, the bottom end flap having a notch complementary in shape with the first and second oblique end lines.

16. The carton and plurality of containers of claim 9, wherein the dispenser pattern further comprises an opening feature in the top panel.

17. The carton and plurality of containers of claim 9, wherein the exiting end panel comprises:

a bottom exiting end flap foldably connected to the bottom panel, the bottom exiting end flap having a V-shaped notch;

a first side exiting end flap foldably connected to the first side panel;

a second side exiting end flap foldably connected to the second side panel; and a top exiting end flap foldably connected to the top panel.

18. The carton and plurality of containers of claim 9, further comprising a handle in the top panel.

19. A method of removing articles from a carton, comprising:

providing the carton and plurality of container of claim 9;

tearing the carton along the dispenser pattern, wherein tearing the carton includes separating the dispenser section to form the dispenser opening, the dispenser opening including a V-shaped portion in the exiting end panel; and removing an article through the dispenser opening.

20. A method of removing containers from a carton, comprising:

providing a carton comprising: a first side panel; a top panel; a second side panel; a bottom panel; an exiting end panel; and a dispenser section defined by a dispenser pattern extending through the top panel, the first side panel, the second side panel, and the exiting end panel, the dispenser pattern including an opening feature in the top panel;

providing a plurality of containers stacked in at least two rows and arranged in at least three columns in the carton, wherein the containers have a common diameter;

tearing the carton along the dispenser pattern, wherein tearing the carton separates the dispenser section to form a dispenser opening, the dispenser opening having a V-shaped portion that terminates at a vertex in a bottom portion of the exiting end panel at a location spaced apart from the bottom panel, and wherein after separating the dispenser section, the exiting end panel is left with a first end retainer section and a second end retainer section, at least one of the end retainer sections retaining at least one of the containers in a topmost row of the containers; and removing a container through the dispenser opening.

21. The method of claim 20, wherein after separating the dispenser section, at least one container in the topmost row of containers can be grasped from the exiting end of the carton and from either side of the carton.

22. The method of claim 21, wherein the dispenser pattern comprises:

a first oblique end tear line extending across the exiting end panel;

a second oblique end tear line extending across the exiting end panel;

a first side tear line extending across the first side panel, at least a portion of the first side tear line being substantially parallel to and spaced from the top panel; and a second side tear line extending across the second side panel, at least a portion of the second side tear line being substantially parallel to and spaced from the top panel.

23. The method of claim 21, wherein tearing the carton comprises:

initiating tearing at the opening feature.

24. A blank for forming a carton for containing a plurality of containers each having a characteristic diameter, the blank comprising:

a first side panel;

a top panel;

a second side panel;

a bottom panel;

a first side exiting end flap extending from the first side panel and along a first marginal area of the blank;

a top exiting end flap extending from the top panel and along the first marginal area of the blank;

a second side exiting end flap extending from the second side panel and along the first marginal area of the blank;

at least one second end flap extending along a second marginal area of the blank; and a dispenser pattern extending through the top panel, the first side panel, the second side panel, the first side exiting end flap, and the second side exiting end flap, wherein the dispenser pattern comprises:

a first oblique tear line extending from a top portion to adjacent a bottom edge of the first side exiting end flap;

a second oblique tear line extending from a top portion to adjacent a bottom edge of the second side exiting end flap;

a first side tear line extending across the first side panel and spaced from the top panel; and a second side tear line extending across the second side panel and spaced from the top panel wherein each of the first side tear line and the second side tear line extends substantially parallel to a fold line connecting the first side panel and the top panel and is spaced from the bottom panel a distance that is greater than the characteristic diameter along an entire length of a respective side tear line.

25. The blank of claim 24, further comprising a bottom exiting end flap foldably connected to the bottom panel, the bottom exiting end flap having a V-shaped notch.

26. The blank of claim 24, wherein the dispenser pattern further comprises an opening feature in the top panel.

27. The blank of claim 24, wherein the blank is constructed from paperboard.

28. A carton and a plurality of containers therein, the containers having at least one common diameter and being arranged in at least two rows and three columns, the carton comprising:

a first side panel;

a top panel;

a second side panel;

an end panel;

an exiting end panel at an exiting end of the carton opposite to the end panel;

a bottom panel; and a dispenser defined by a dispenser pattern extending at least through the top panel, the first side panel, the second side panel, and the exiting end panel, wherein the dispenser pattern defines a dispenser section that is at least partially separable along the dispenser pattern to form a dispenser opening, the dispenser section having a substantially V-shaped section in the exiting end panel that terminates at a vertex in a lower portion of the exiting end panel, wherein the dispenser pattern comprises:

an opening feature in the top panel;

a first oblique end line extending across the exiting end panel; and a second oblique end line extending across the exiting end panel, wherein the first and second oblique end lines subtend an angle of between thirty-five and one hundred and twenty degrees, and wherein the first and second oblique end lines terminate adjacent to one another at respective end points that form the vertex of the V-shaped section, the end points being proximate to and spaced from the bottom panel, the first and second oblique end lines define first and second end retainer sections in the exiting end panel, and after separating the dispenser section, at least one of the end retainer sections retains at least one of the containers in a topmost row of the containers.

29. The carton and plurality of containers of claim 28, wherein after separating the dispenser section, at least one container in the topmost row of containers can be grasped from the exiting end of the carton and from either side of the carton.

30. The carton and plurality of containers of claim 29, wherein the dispenser pattern further comprises:

a first side tear line extending across the first side panel, at least a portion of the first side tear line being substantially parallel to and spaced from the top panel; and a second side tear line extending across the second side panel, at least a portion of the second side tear line being substantially parallel to and spaced from the top panel.

31. The carton and plurality of containers of claim 29, wherein the exiting end panel comprises a bottom exiting end flap foldably connected to the bottom panel, the bottom exiting end flap having a V-shaped notch.

32. The carton and plurality of containers of claim 29, wherein the exiting end panel comprises:

a bottom exiting end flap foldably connected to the bottom panel, the bottom exiting end flap having a notch formed at a distal edge of the bottom exiting end flap;

a first side exiting end flap foldably connected to the first side panel;

a second side exiting end flap foldably connected to the second side panel; and a top exiting end flap foldably connected to the top panel.

33. The carton and plurality of containers of claim 5, the dispenser pattern further comprising a first side tear line extending across the first side panel, at least a portion of the first side tear line being substantially parallel to the bottom panel and spaced apart from the bottom panel a distance that is greater than the at least one common diameter of the containers.

34. The carton and plurality of containers of claim 5, the dispenser pattern further comprising a first side tear line extending across the first side panel, at least a portion of the first side tear line being substantially parallel to the bottom panel and spaced apart from the bottom panel a distance that is between about 105% and about 195% the at least one common diameter of the containers.

35. The method of claim 20, the dispenser pattern further comprising a first side tear line extending across the first side panel, at least a portion of the first side tear line being substantially parallel to the bottom panel and spaced apart from the bottom panel a distance that is greater than the common diameter of the containers.

36. The method of claim 20, the dispenser pattern further comprising a first side tear line extending across the first side panel, at least a portion of the first side tear line being substantially parallel to the bottom panel and spaced apart from the bottom panel a distance that is between about 105% and about 195% the common diameter of the containers.

37. The carton and plurality of containers of claim 15 wherein the notch is a V-shaped notch having a vertex in the bottom exiting end flap spaced apart from the fold line, the first and second oblique end lines having respective lowermost points that converge at a location spaced from the bottom panel to form the vertex of the V-shaped section, the vertex of the V-shaped notch being in an overlapping relationship with the vertex of the V-shaped section.

* * * * *